United States Patent [19]

Koller

[11] 4,205,759

[45] Jun. 3, 1980

[54] CLOSURE HAVING VENT MEANS FOR LIQUIDS UNDER PRESSURE

[76] Inventor: Josef Koller, 8077 AU am Aigen 3, über Reichertshofen 2, Fed. Rep. of Germany

[21] Appl. No.: 937,269

[22] Filed: Aug. 28, 1978

[30] Foreign Application Priority Data

Aug. 30, 1977 [DE] Fed. Rep. of Germany ..... 2738938

[51] Int. Cl.[2] ..... B65D 41/32

[52] U.S. Cl. ..... 220/271; 220/258; 220/373

[58] Field of Search ..... 220/266–273, 220/359, 257, 258, 373; 222/7 R, 541

[56] References Cited

U.S. PATENT DOCUMENTS

| | | | |
|---|---|---|---|
| 3,583,595 | 2/1969 | Eike | 220/270 |
| 3,667,643 | 6/1972 | Patel | 220/270 |
| 3,883,034 | 5/1975 | Rausing | 220/269 X |
| 4,146,149 | 3/1979 | Beveridge | 220/271 |

*Primary Examiner*—George T. Hall

*Attorney, Agent, or Firm*—Brady, O'Boyle & Gates

[57] ABSTRACT

A piece of porous foil larger than the removable portion of the lid of a can is connected to the under surface of the removable lid portion and overlaps the edges defining the can opening on the interior surface of the lid, whereby liquid is prevented from spurting out of the can with escaping gas upon initial partial opening of the removable portion, and the piece of porous foil is fully removable with the removable lid portion.

2 Claims, 2 Drawing Figures

CLOSURE HAVING VENT MEANS FOR LIQUIDS UNDER PRESSURE

Figure 1:
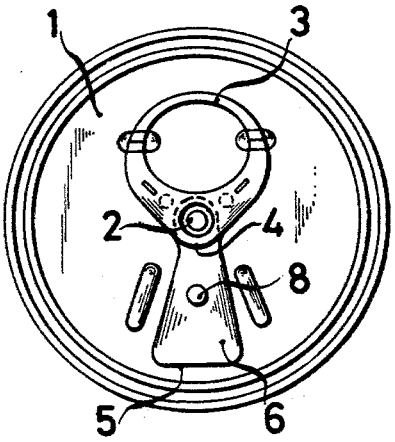

The invention concerns an improvement on tin cans for liquids under pressure.

In beverage cans, in particular those that are stored in vending machines and that drop after insertion of a coin, the pressure gas tends to escape from the liquid through the impact of the can on the bottom of the place of removal, so that, with the opening of the can at the place of removal, the pressure gas spurts out along with the liquid. Only in exceptional instances is that possible without affecting the hands and the garments of the user.

At the basis of this invention lies the task to eliminate this deficiency in a possibly simple fashion.

The task is solved through the invention by the fact that a piece of porous foil is provided under the lid of the can, covering the opening provided for the removal of the liquid. This porous foil works here like the known sieves placed before the mouth of a water faucet. When the can is opened, the liquid does not spurt out uncontrollably any more, but flows, in the least advantageous case, slowly over the upper side of the lid of the can. As a rule the pressure gas will merely escape, and the small quantity of liquid that escapes concurrently can always flow back into the can through the full opening in the can.

The drawing represents an example of a can lid in accordance with the invention, and shows namely:

FIG. 1 the outer side of the can lid and

Figure 2:
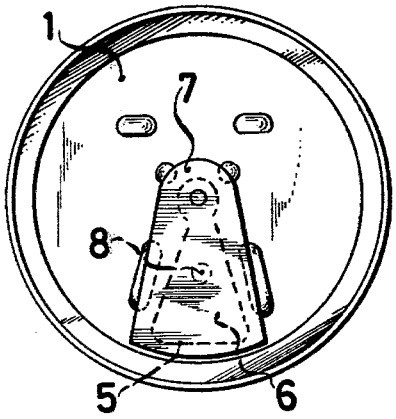

FIG. 2 its inner side.

On the lid 1 of a tin can, a ring 3 is riveted in a known fashion at point 2. When the ring is lifted, its ridge 4 perforates and subsequently presses inward a surface 6 defined by a perforated line 5. At that moment the liquid can escape in a more or less substantial jet, according to the pressure present in the can. This procedure lasts admittedly only the short time until the excess pressure in the can has been lowered sufficiently. But this short time is sufficient to let a jet—that used to flow over the hands and the garments of the user—escape through the at first only small opening in the can lid.

In conformity with the invention, a piece of porous foil 7 is provided under the surface 6 of the lid 1 presently defined by the perforated line 5. The foil is attached at point 8 and overlaps surface 6. At the moment the ridge 4 is pressed into the lid 1, the liquid contained in the can is largely retained and mostly the pressure gas escapes. If ring 3 is lifted subsequently in the known manner, the entire opening is exposed and it is possible to empty the can of its contents effortlessly and without inconvenience. In accordance with the example of execution, the additional small pice of porous foil is held in place, for instance, by means of a rivet 8 on the surface defined by the perforated line 5, as is also the case with ring 3.

I claim:

1. In an easy opening can containing pressurized liquid having a pull tab riveted to a tear portion defined by a score line in the can lid, the improvement comprising, a piece of porous foil secured only to the bottom surface of the tear portion within the can, the area covered by the piece of foil being larger than the tear portion, whereby when the container is initially opened the porous foil functions as a sieve allowing pressurized gas to pass therethrough to escape to the atmosphere while substantially the liquid from passing therethrough and escaping to the atmosphere, the porous foil being totally removable with the pull tab when the can is fully open.

2. In an easy opening can according to claim 1, wherein the porous foil is secured to the bottom surface of the tear portion by means of a rivet.

* * * * *